United States Patent [19]

Frearson

[11] Patent Number: 4,704,888

[45] Date of Patent: Nov. 10, 1987

[54] BREAKSTEM FASTENER INSTALLATION TOOL

[75] Inventor: William H. Frearson, Letchworth, England

[73] Assignee: Avdel Limited, Hertfordshire, England

[21] Appl. No.: 859,839

[22] Filed: May 5, 1986

[30] Foreign Application Priority Data

May 10, 1985 [GB] United Kingdom ..... 8511946

[51] Int. Cl.[4] ..... B21J 15/20

[52] U.S. Cl. ..... 72/391; 29/243.53

[58] Field of Search ..... 29/243.53, 243.54; 72/391, 453.17, 453.19

[56] References Cited

U.S. PATENT DOCUMENTS

| | | | |
|---|---|---|---|
| 3,451,248 | 1/1967 | Bell . | |
| 3,523,441 | 8/1970 | Bell et al. | 72/391 |
| 4,027,520 | 6/1977 | Klein | 72/391 |
| 4,275,582 | 6/1981 | Sheffield | 72/391 |
| 4,281,531 | 8/1981 | Ehmann et al. | 72/391 |
| 4,454,746 | 6/1984 | Schwab | 72/391 |
| 4,515,005 | 5/1985 | Klein | 72/391 |
| 4,517,820 | 5/1985 | Oefinger et al. | 72/391 |

FOREIGN PATENT DOCUMENTS

| | | |
|---|---|---|
| 0444494 | 7/1981 | Fed. Rep. of Germany . |
| 2116102 | 3/1982 | United Kingdom . |

*Primary Examiner*—Frederick R. Schmidt
*Assistant Examiner*—Steven P. Schad
*Attorney, Agent, or Firm*—Oblon, Fisher, Spivak, McClelland, & Maier

[57] ABSTRACT

A breakstem rivet installation tool includes an airflow ejector for ejecting broken-off stems through a rear pipe (23) mounted on the tool housing (11). The ejector is provided by the annular gap (28) between the front-end of the rear pipe (23) and the rear-end part (26) of an extension pipe (25) mounted on the reciprocable stem-pulling draw rod (13). In order to adjust the rate of air-flow through the ejector, the rear pipe (23) is axially adjustable to vary the size of the annular gap (28). To this end, the pipe (23) is screw-threaded into the housing, and its position can be locked by a lock nut (62). The range of adjustment of the ejector flow includes complete shutting off the air flow.

8 Claims, 2 Drawing Figures

BREAKSTEM FASTENER INSTALLATION TOOL

Figure 1:
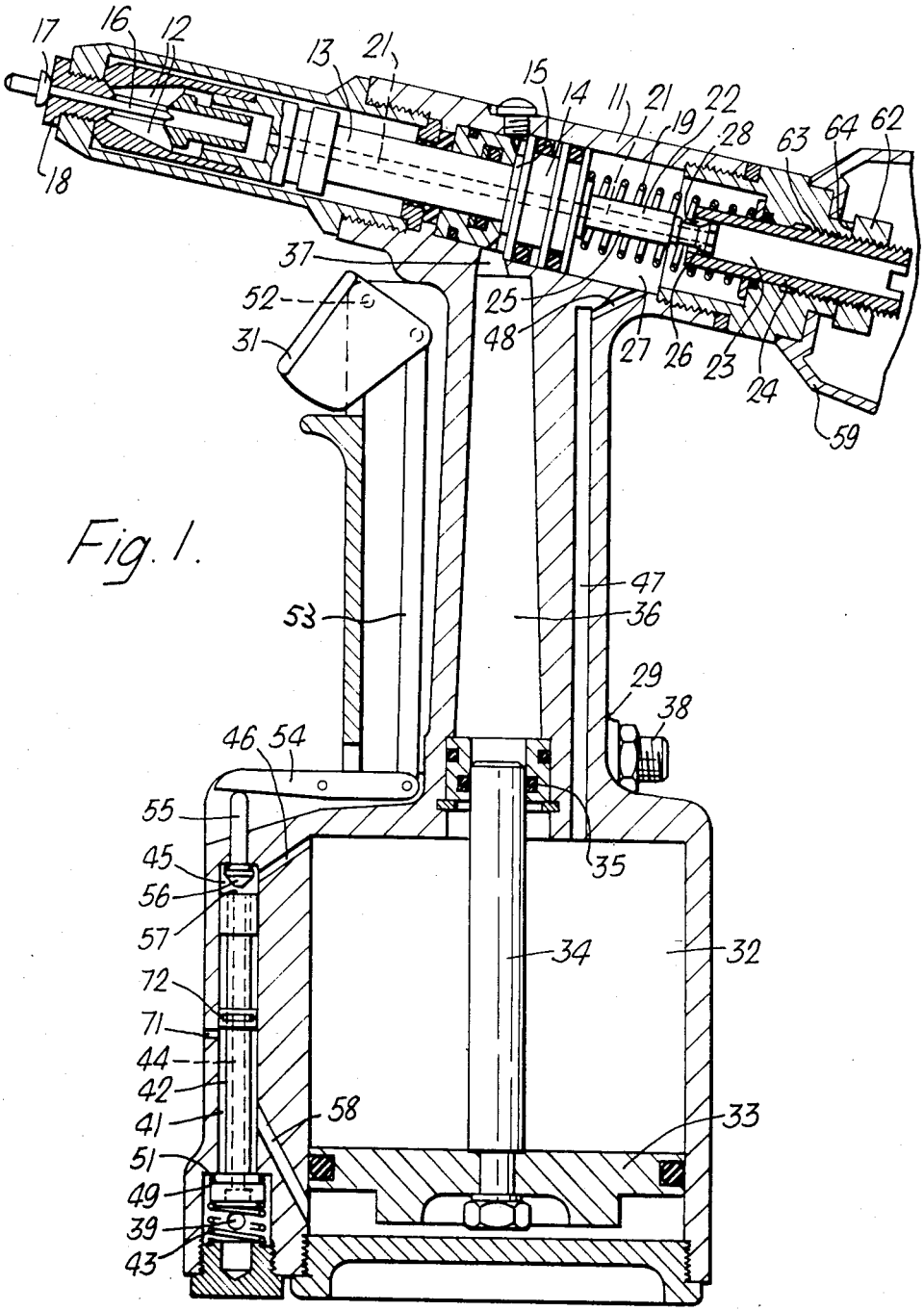

The invention relates to a breakstem fastener installation tool. Such a tool is used to install a fastener such as a rivet or a bolt in which a projecting stem is used in the installation process, for example by applying tension or rotational force to the stem, and the projecting part of the stem is thereafter broken off in order to produce an installed fastener having a substantially flush head surface. It is common for such tools to be provided with an airflow ejector e.g. for removing the broken-off portion of the stem from the fastener and from the working part of the installation tool which engages the stem, so that the tool is ready to engage and install the next fastener. Alternatively or additionally, such an airflow ejector may be used to provide suction to retain a fastener in the nosepiece of the tool prior to installation. Such an airflow ejector is particularly convenient in the case of an installation tool which is powered by compressed air, since a supply of the latter is already provided at the tool, but airflow ejectors can be provided on other types of tools.

Since the airflow ejector uses up energy in the form of compressed air, it is desirable that the ejector uses no more compressed air than is necessary for its proper operation. Thus the rate of airflow through the ejector should be adjustable, for example in accordance with the size or weight of the broken-off portions of stems and/or the distance through which they are to be removed. It may also be desirable to be able to shut off the ejector completely.

It would be possible to provide an airflow adjusting valve in the air line to the ejector, but this involves the cost of providing and assembling extra components. It is also known to arrange an airflow ejector so that it automatically shuts off at the end of each pulling stroke of the installation tool and automatically starts up again before the start of the next pulling stoke. However the airflow through the ejector cannot be adjusted, nor completely shut off.

The present invention is intended to provide an ejector in which the airflow can be varied and/or shut off completely, requiring the minimum of extra components.

The present invention provides a breakstem fastener installation tool which includes a housing, stem-pulling means reciprocable with respect to the housing to install a fastener, and an airflow ejector comprising two adjacent and axially aligned pipes which form at least part of a passageway along which broken-off stems are ejected, with airflow inlet means located at the junction of the two pipes, the relative axial position of the two pipes being adjustable so as to adjust the airflow inlet means and thus adjust the rate of airflow through the ejector, in which one of the two adjacent and axially aligned pipes is connected to the pulling means for reciprocation therewith, and in which the other of the pipes is connected to the housing and is adjustable axially with respect thereto so that the relative axial position of the two pipes, at least when the stem-pulling means is in a forward position more remote from the other pipe, allows airflow through the airflow inlet means.

The invention also provides a break stem fastener installation tool which includes a housing, stem-pulling (i.e., stem-engaging and pulling) means reciprocable with respect to the housing to install a fastener, and an airflow ejector comprising two adjacent and axially aligned pipes which form at least part of a passageway along which broken-off stems are ejected, with airflow inlet means located at the junction of the two pipes, the relative axial position of the two pipes being adjustable so as to adjust the airflow inlet means and thus adjust the rate of airflow through the ejector, in which one of the two adjacent and axially aligned pipes is connected to the pulling means for reciprocation therewith, and in which the other of the pipes is connected to the housing and is adjustable axially with respect thereto so that the relative axial position of the two pipes, at least when the stem-pulling means is in a forward position more remote from the other pipe, allows airflow through the airflow inlet means.

Preferably one pipe comprises a first part having an external diameter which is a close fit within the bore of the adjacent end of the other pipe and a second part which is of smaller external diameter and is located at least partially within the aforesaid bore.

Preferably one pipe comprises a first part having an external diameter which is a close fit within the bore of the adjacent end of the other pipe and a second part which is of smaller external diameter and is located at least partially within the aforesaid bore, adjustment of the relative axial positions of the two pipes so as to fit the first part of the aforesaid one pipe into the aforesaid bore of the other pipe being effective to close the airflow inlet means.

Preferably the airflow inlet means is provided by the annular space of the aforesaid bore around the second part of the aforesaid one pipe.

Preferably the aforesaid other one of the pipes is screw-threaded into the housing and is axially adjustable by rotation with respect to the housing.

Preferably the screw-threaded pipe is provided with a lock-nut whereby its position of axial adjustment can be fixed.

Figure 2:
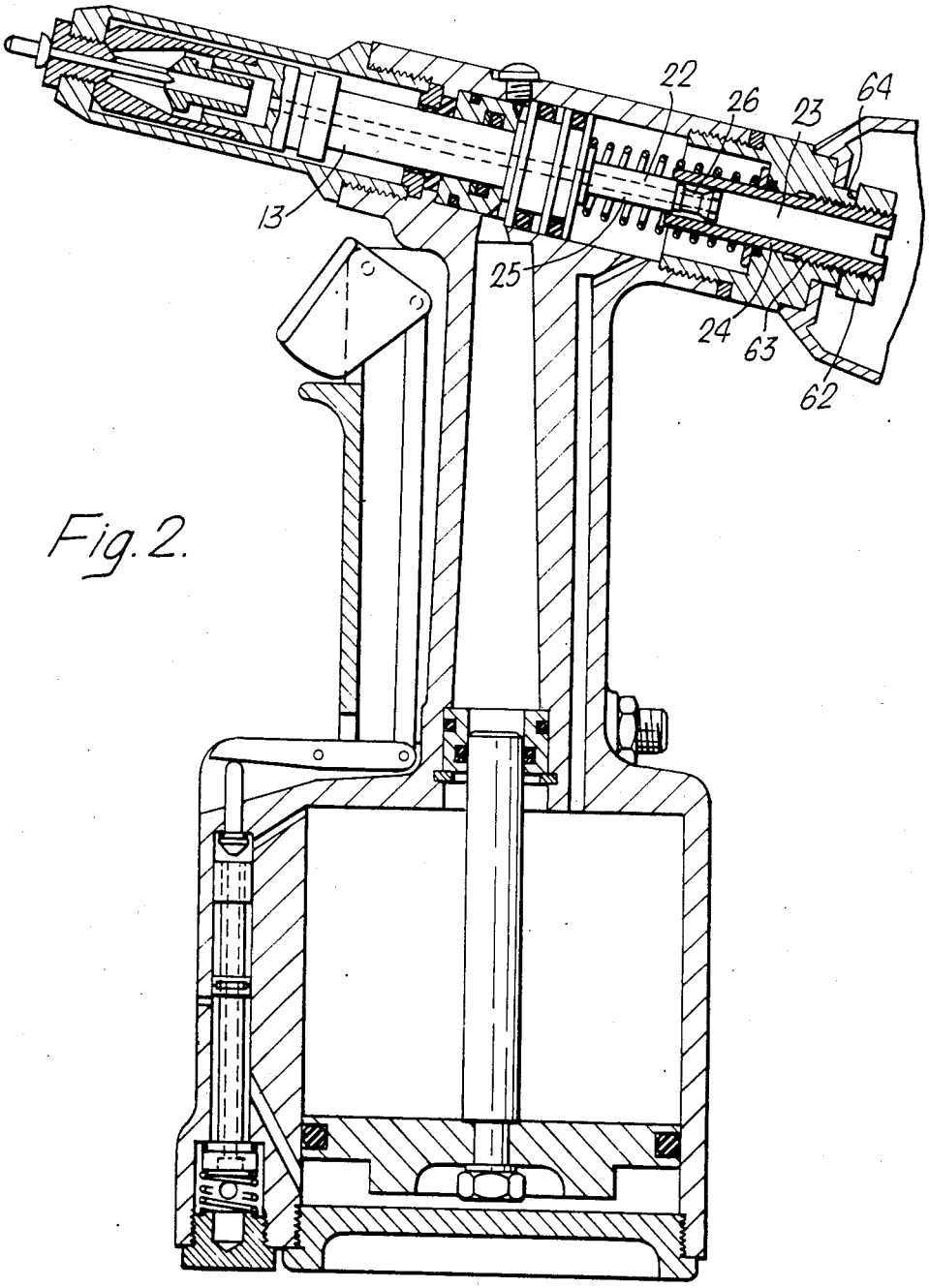

A specific embodiment of the invention will now be described by way of example and with reference to the accompanying drawings, in which:

FIG. 1 is an axial section through a breakstem rivet installation tool incorporating an airflow ejector, showing the ejector on; and FIG. 2 is similar to FIG. 1 but shows the ejector shut off.

The tool of this example includes a housing 11 containing stem-pulling means comprising a set of jaws 12 carried on the front end of a reciprocable draw-rod 13. The draw-rod is reciprocable within the housing, by means of a piston 14 secured to its rear end and sliding within a hydraulic cylinder 15. The draw-rod is urged rearwardly (so that the jaws 12 grip and pull the stem 16 of a breakstem rivet 17 inserted in the nosepiece 18 at the front of the housing) by pumping hydraulic fluid under pressure into the cylinder 15 in front of the piston 14. The draw-bar is returned forwards by a return spring 19 behind the piston 14.

Broken-off rivet stems are removed from the jaws 12 along a passage leading rearwardly from the jaws. The passage is provided by a bore 21 extending rearwardly through the draw-bar 13 and piston 14 and through an extension pipe 22 carried on the rear of the piston 14 and drawbar. The stem removal passage also comprises a bore 23 through a pipe 24 which is mounted at the rear of the housing, adjacent the extension pipe 22 and in axial alignment with it.

The extension pipe 22 comprises two portions, a first portion 25 which provides most of the length of the pipe and is of an external diameter which is a close fit within the bore 23 of the rear pipe 24, and a second, shorter and rearwardly extending part 26 which is of smaller external diameter. When the pipes are in the relative axial positions shown in FIG. 1, the rearwards half of the part 26 is within the forwards end of the bore 23 of the rear pipe 24. By means which be described below, compressed air is fed to the space 27 around the extension pipe 22 (this space 27 is in fact part of the hydraulic cylinder 15 behind the piston 14, into which space hydraulic fluid does not enter). The annular gap 28 between the exterior of extension pipe part 26 and the wall of the bore 23 of the rear pipe 24 provides airflow inlet means to the stem ejector passage comprising the bores 21 and 23 and provides a rearwards airflow along the bore 23 of the rear pipe 24, the exterior of the extension pipe part 26 being shaped to increase this airflow. This tends to suck air rearwardly along the bore 21, which assists both in pulling broken-off stems rearwardly out of the jaws, and in retaining a rivet stem within the tool nosepiece 18 until the jaws 12 close on it and grip it.

The remainder of the tool, which essentially comprises a pneumatic/hydraulic intensifier system for providing hydraulic fluid under pressure to drive the head piston 14, will now be briefly described, although this part of the tool is largely conventional and well-known in the art of installing breakstem rivets. Integral with the head housing 11 is an intensifier housing 29 substantially at right angles, the two housings being provided as part of a single casting. The housing 29 forms a handle by which the tool may be held in an operator's hand, and carries on its exterior a trigger 31 for actuating the tool. The intensifier comprises a pneumatic cylinder 32 in which slides a double-acting pneumatic piston 33. The piston 33 is secured to a hydraulic plunger rod 34 which extends through a seal 35 into a hydraulic chamber 36, which communicates via a bore 37 with the hydraulic head cylinder 15 in front of the head piston 14, the chamber 36, bore 37 and space 15 in front of the head piston being full of hydraulic fluid.

The intensifier housing 29 carries a compressed airline connector 38 by means of which compressed air is supplied to an inlet port 39 at the bottom end of an elongated valve chamber 41 which carries a reciprocable valve spool 42. The valve spool is urged by means of a spring 43 into an upper position, shown in FIGS. 1 and 2. When the valve spool is in this position compressed air passes up through a bore 44 along the center of the spool, into the space 45 at the top of the valve chamber 41, and through an inclined bore 46 into the top of air cylinder 32. Also from the top of air cylinder 32 another bore 47 and 48 connects to the space 27 around the extension pipe 25, to provide the ejector compressed air feed referred to above. The pressure of air above the piston 33, and the urging of return spring 19, keep the air piston 33 at the bottom of its stroke and the head piston 14 in its forward position. When the valve spool 42 is in its uppermost position, as illustrated in FIG. 1, under the urging of spring 43, a seal 49 around the lower enlarged end of the spool seats against a shoulder 51 on the valve chamber, to prevent compressed air passing up the valve chamber around the outside of the valve spool.

Trigger 31 can rock about a pivot 52 and is connected by a link 53 to one end of a rocking lever 54. The other end of the rocking lever 54 rests on the upper end of plunger 55 which protrudes through the tool housing, the lower end of the plunger carrying a conical face 56, which, when pushed into contact with the upper end 57 of the bore 44 through the valve spool 42, seals it off and stops compressed air emerging from the bore.

The normal or un-actuated condition of the tool is as shown in FIG. 1.

When the operator then presses trigger 31, the plunger 55 is pushed downwards. As soon as the conical face 56 seats on the upper end 57 of the spool, the supply of air to the top of the air cylinder 32, and to the ejector, is shut off. As the plunger 55 continues to descend, it pushes down the valve spool 42, and the seal 49 unseats from shoulder 51. This allows compressed air to pass up into the valve chamber around the outside of the valve spool. This compressed air passes by means of an inclined bore 58, to the bottom of the cylinder 32, below the air piston 33. This forces the air piston 33 upwards, there being no compressed air from the inlet applied to the space above it, and the air already in that space escaping through bores 47, 48 and the ejector. The rising air piston 33 pushes hydraulic plunger rod 34 up into the hydraulic chamber 36. The displacement of hydraulic fluid forces the head piston 14 rearwardly. The jaws 12 grip the rivet stem 16 and pull it, thereby installing the rivet 17. As the head piston 14 retracts, the larger diameter portion 25 of the extension pipe 22 enters the front end of the bore 23 of rear pipe 24, thus shutting of the ejector, although at this stage no air is being fed to the ejector. The tension exerted on the rivet stem increases to the point at which the stem breaks, at a position flush with or inside the installed rivet, the broken-off part of the stem being retained between the jaws. The operator releases the trigger 31, and the valve spool 42 returns, under the urging of spring 43, to its upper position. Supply of compressed air is shut off from below air piston 33 and is re-connected to above air piston 33, and to the ejector. The pressure on the hydraulic fluid in chamber 36 is released, and head piston 14 moves forwards again under the urging of spring 19.

A main exhaust port 71, halfway up the valve chamber 41, connects the valve chamber to outside atmosphere. A land and seal 72 on the valve spool 42 move from one side to the other of the exhaust port 71, during movement of the valve spool between its two positions, to co-operate with the exhaust port 71 in venting to atmosphere that part of the air cylinder 32, on one or other side of piston 33, which is unpressurised.

When the larger diameter portion 25 of extension pipe 22 leaves the front end of bore 23 of rear pipe 24, the ejector comes into action again, since air is already being supplied to it. When the draw rod reaches its forwards position, the jaws 12 open slightly due to contact with the rear of the nosepiece 18, and release their grip on the broken-off stem. The broken-off stem is then sucked rearwardly along the passage provided by bores 21 and 23, due to the air-flow of the ejector, and pushed out of the tool, where there may be provided a container such as 59 to catch and retain it. The tool is then ready for the stem of a further rivet to be inserted in the nosepiece, to be installed by the tool.

As mentioned previously, the action of the ejector when it is running causes some airflow rearwardly along the bore 21, which assists in retaining a rivet in the nosepiece while the jaws have not yet gripped it, which does not occur until the trigger 31 is pressed. If the tool is to be used in a position with the nosepiece pointing downwards, so that the rivet tends to drop out of the nosepiece, clearly the use of the ejector to retain the rivet is a great advantage. However, the ejector when running uses up compressed air and is also noisy. Hence many operators of such a tool would find it advantageous to be able to adjust the rate of airflow through the ejector to the minimum necessary for use in the particular conditions of use and size of rivet being installed, at different times, and also to be able to shut the ejector off completely if possible.

The installation tool of this example provides both these capabilities. The rear pipe 24 is axially adjustable with respect to the housing 11, and therefore with respect to the extension pipe 22 when the latter is in its forwards position illustrated in FIGS. 1 and 2. This is achieved, in this example, by the exterior of the appropriate part of the rear pipe 24 being screw-threaded, to mate with a screw-threaded bore 63 through the rear of the housing 11. A lock nut 62 on the protruding rear end of the rear pipe bears against the rear face 64 of the housing and can be tightened to lock the rear pipe 24 in position. The position of the rear pipe 24 is adjusted axially, to adjust the airflow through the ejector, including adjusting it to nil to shut it off, by slackening the lock nut 62, screwing the rear pipe 24 in or out to the desired position, and re-tightening the lock nut 62.

FIG. 2 shows the position where the rear pipe 24 is sufficiently far forwards that the rear end of the forwards larger diameter part 25 of extension pipe 22 enters the bore 23 of rear pipe 24, even when the draw rod 13 is in its forward position. This completely closes the annular gap 28 between the extension pipe 22 and the bore 23 of the rear pipe 24, thus shutting off the ejector completely. The position of the rear pipe 24 may be adjusted to any position intermediate those shown in FIGS. 1 and 2, to set the desired rate of airflow through the ejector.

The invention is not restricted to the details of the foregoing example. For instance, the relative axial position of the rear pipe may be arranged to be adjusted by other means than rotation of a screw-threaded member.

I claim:

1. A break stem fastener installation tool which includes:

a housing;

stem engaging and pulling means reciprocable with respect to the housing to install a fastener;

and an airflow ejector comprising two adjacent and axially aligned pipes which form at least part of a passageway along which broken-off stems are ejected, with airflow inlet means located at the junction of the two pipes, the relative axial position of the two pipes being adjustable so as to adjust the airflow inlet means and thus adjust the rate of airflow through the ejector;

in which one of the two adjacent and axially aligned pipes is connected to the pulling means for reciprocation therewith, and in which the other of the pipes is connected to the housing and is adjustable axially with respect thereto so that the relative axial position of the two pipes, at least when the stem engaging and pulling means is in a forward position more remote from the other pipe, allows airflow through the airflow inlet means.

2. A break stem fastener installation tool which includes:

a housing;

and stem engaging and pulling means reciprocable with respect to the housing to install a fastener;

and an airflow ejector comprising two adjacent and axially aligned pipes which form at least part of a passageway along which broken-off stems are ejected, with airflow inlet means located at the junction of the two pipes, the relative axial position of the two pipes being adjustable so as to adjust the airflow inlet means and thus adjust the rate of airflow through the ejector;

in which one of the adjacent and axially aligned pipes is connected to the stem engaging and pulling means for reciprocation therewith, and in which the other of the pipes is connected to the housing and is adjustable axially with respect thereto between a first position in which the relative axial position of the two pipes allows the airflow inlet means to open at least when the stem engaging and pulling means is in a forward position more remote from the second pipe, and a second position in which the relative axial position of the pipes keeps the airflow inlet means closed throughout the reciprocation of the stem engaging and pulling means.

3. A tool as claimed in claim 1, in which one pipe comprises a first part having an external diameter which is a close fit within the bore of the adjacent end of the other pipe and a second part which is of smaller external diameter and is located at least partially within the aforesaid bore.

4. A tool as claimed in claim 2, in which one pipe comprises a first part having an external diameter which is a close fit within the bore of the adjacent end of the other pipe and a second part which is of smaller external diameter and is located at least partially within the aforesaid bore, adjustment of the relative axial positions of the two pipes so as to fit the first part of the aforesaid one pipe into the aforesaid bore of the other pipe being effective to close the airflow inlet means.

5. A tool as claimed in claim 3 or claim 4, in which the airflow inlet means is provided by the annular space of the aforesaid bore around the second part of the aforesaid one pipe.

6. A tool as claimed in claim 1, in which the aforesaid other one of the pipes is screw-threaded into the housing and is axially adjustable by rotation with respect to the housing.

7. A tool as claimed in claim 2, in which the aforesaid other one of the pipes is screw-threaded into the housing and is axially adjustable by rotation with respect to the housing.

8. A tool as claimed in claim 6 or claim 7, in which the screw-threaded pipe is provided with a lock-nut whereby its position of axial adjustment can be fixed.

* * * * *

UNITED STATES PATENT AND TRADEMARK OFFICE

CERTIFICATE OF CORRECTION

PATENT NO. : 4,704,888

DATED : November 10, 1987

INVENTOR(S) : FREARSON, WILLIAM H.

It is certified that error appears in the above-identified patent and that said Letters Patent is hereby corrected as shown below:

Cover Page, under heading "References Cited--Foreign Patent Documents", please change "0444494 7/1981 Federal Republic of Germany" to --0044494 7/1981 European Patent Application--

Column 5, line 57, please change "pulling means" to --engaging and pulling means--.

Signed and Sealed this

Twenty-sixth Day of July, 1988

*Attest:*

DONALD J. QUIGG

*Attesting Officer*

*Commissioner of Patents and Trademarks*